United States Patent [19]

Enchev et al.

[11] 4,024,035

[45] May 17, 1977

[54] METHOD FOR ELECTRIC EXTRACTION OF NON-FERROUS METALS FROM THEIR SOLUTIONS

[75] Inventors: Ivan Dimitrov Enchev; Eliesser Persiado Ilel; Nikola Tzanov Kunchev; Kiril Georgiev Harizanov, all of Plovdiv; Vladimir Vetov Genevski, Sofia; Nedelcho Draganov Draganov, Plovdiv; Georgi Alexandrov Haralampiev, Sofia; Todor Ivanov Smilenov, Plovdiv; Yossif Genchev Stoyanov, Plovdiv; Alexander Minchev Alexandrov, Plovdiv, all of Bulgaria

[73] Assignee: Nipki po Tzvetna Metalurgia, Plovdiv, Bulgaria

[22] Filed: July 7, 1975

[21] Appl. No.: 593,777

[30] Foreign Application Priority Data

July 10, 1974 Bulgaria ..... 27211

[52] U.S. Cl. ..... 204/105 R; 204/228

[51] Int. Cl.[2] ..... C25C 1/00; C25D 5/18

[58] Field of Search ..... 204/112, 114, 105 R, 204/228, 267, 268

[56] References Cited

UNITED STATES PATENTS

| | | | |
|---|---|---|---|
| 2,119,936 | 6/1938 | White | 204/228 |
| 3,717,568 | 2/1973 | Brown et al. | 204/228 |
| 3,755,113 | 8/1973 | Entshev et al. | 204/DIG. 9 |
| 3,799,850 | 3/1974 | Entshev et al. | 204/DIG. 9 |

*Primary Examiner*—T. M. Tufariello

[57] ABSTRACT

Method of and system for electric extraction of non-ferrous metals from their solutions. The process is effected by applying a reversing electric current of different duration for the current for the electric extraction and the dissolution. The process is conducted simultaneously in two groups of electrolytic baths, the electric current for dissolution for each group of electrolytic baths being provided by the electric current for electric extraction in the other group of electrolytic baths.

2 Claims, 3 Drawing Figures

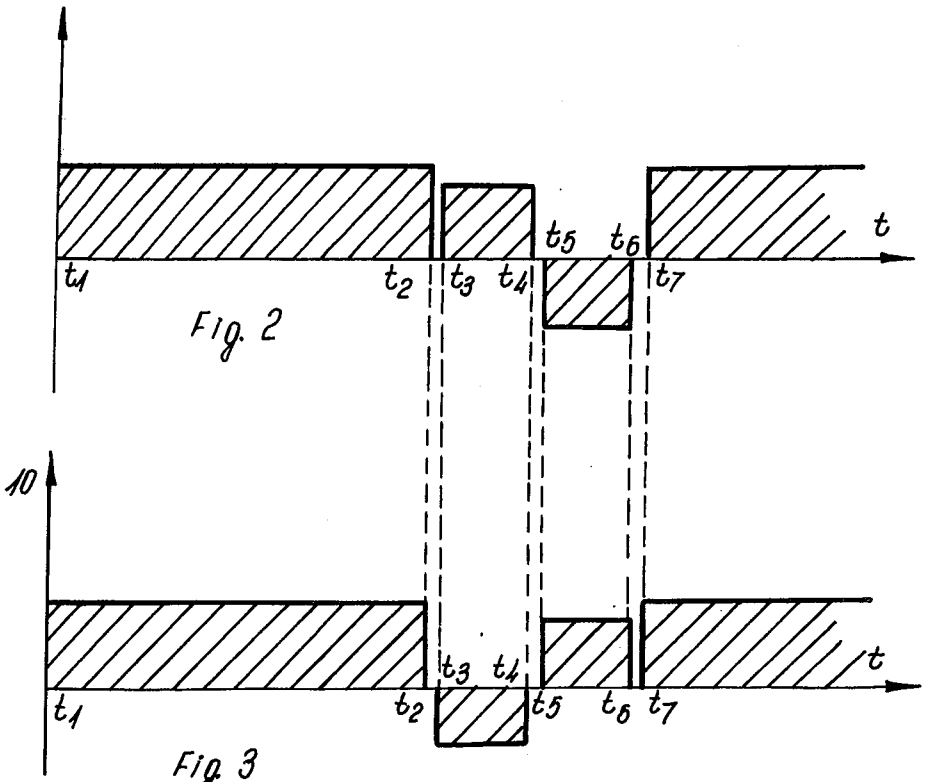
Fig. 2
Fig. 3
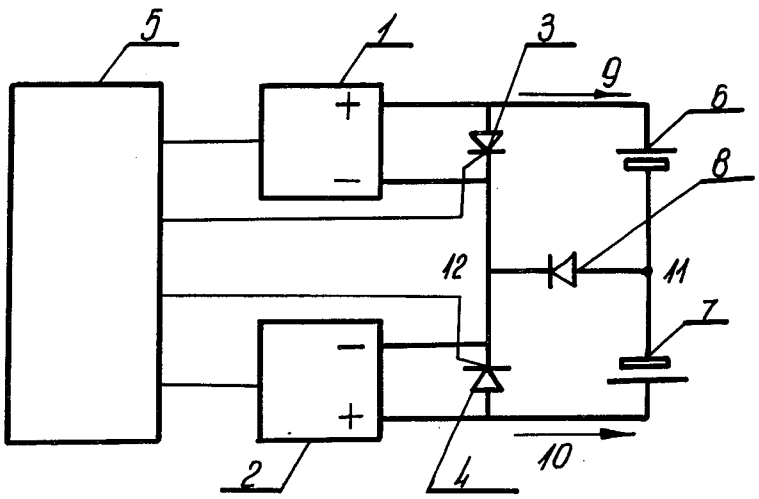
Fig. 1

METHOD FOR ELECTRIC EXTRACTION OF NON-FERROUS METALS FROM THEIR SOLUTIONS

This invention relates to a method of and an electric system for electric extraction of non-ferrous metals from thier solutions.

A system for effecting a current direction reversing electric extraction is known in which there are employed a controllable thyristor current rectifier and a mains-guided inverter with a common control block, which are connected to a group of electrolytic baths. The current rectifier operates with a current which has the same direction of polarity as the straight electrode polarity of the baths, and the inverter supplies the opposite electrode polarity to the baths.

It is a drawback of this system, that in any moment only either the current rectifier or the inverter is operating; for this reason their total power is not fully utilized. Moreover the baths have a high inherent electromotive voltage and a considerable amount of reserve energy; therefore the inverter returns a large part of the reserve energy, stored in the baths back to the mains, while another part of this energy is consumed as losses in the inverter itself. The return of energy takes place as pulses with a steep front, which impairs the form of the supply voltage. The thyristors operate at a small angle of conductivity, which requires a considerable increase of their number. The periodic switching-on and -off with energy return of such a high power station affects the normal operation of other consumers connected to the electric mains.

Also known are a method of and a device for reverse electric in which there is used a current rectifier which during the period of reverse current flow is switched-off, the baths are short-circuited, and the reverse current passes only because of the energy stored in the baths. It is a drawback of this method that because of the creation of short-circuit currents it is not possible to effect an effective control and regulation.

It is therefore a general object of this invention to provide a method and an electric system which permits a more omplete utilization of two current rectifiers in operating conditions, and an intensifying of the production of non-ferrous metals and an increase of efficiency of electric extraction.

These objects are achieved by a method for electric extraction of non-ferrous metals from their solutions in which the process is effected by using a reversive electric current of different duration in electric extraction and in dissolution in two groups of electrolytic baths, and the electric current for dissolution in each bath group is provided by the electric current for electric extraction in another group of electrolytic baths.

The method is effected by means of a device which comprises a controllable current rectifier and a control block and using a second controllable current rectifier, and each one of the controllable current rectifiers is connected to a separate group of electrolytic baths through a common diode switch. Both groups of electrolytic baths and both controllable current rectifiers are connected in series and in opposite directions with respect to each other. The common diode switch is connected in its conduction direction between the common points of the groups of electrolytic baths and the controllable current rectifiers. There are connected corresponding controllable thyristor switches for direct current in parallel and in the same direction as the controllable current rectifiers. The control block is common for the current rectifiers and the switches.

The advantages of the method and electric system according to the present invention are the intensifying of the production of non-ferrous metals, the increase of efficiency of electric extraction, a total utilization of the controllable current rectifiers under working conditions without the need to pass over the inverter conditions up to 37% assymmetry in the groups of electrolytic baths, savings of electric energy, and facilitation of the operation of the supply station and the remaining consumers connected to it, as well as the avoidance of operation with short-circuit currents. Moreover, the system permits variation of the current density from 100 to 1500 $Am^2$, depending on the allowable requirements for different metals, to effect the process at a duration of the metal deposition onto the cathode for working cycle of 12 to 144 hours.

For a better understanding of the method and the electric system of the invention, reference should be made to the accompanying drawings, where there is illustrated a preferred embodiment of the invention. In the drawings: p FIG. 1 is a circuit diagram of the electric system for electric extraction of non-ferrous metals;

FIG. 2 is a time (the abscissa) diagram, illustrating the intensity (the ordinate) and the direction of the currents, passing through one of the bath groups; and FIG. 3 is a time diagram, illustrating the intensity and the direction of the currents, passing through the second bath group, FIGS. 2 and 3 being correlated as to time.

The electric system for electric extraction shown in FIG. 1 comprises two controllable thyristor current rectifiers 1, 2 and controllable thyristor direct current switches 3, 4 which are connected in parallel and in the same direction to their rectifiers, the switches being controlled together with the current rectifiers 1, 2 by a common control block 5. The positive pole of current rectifier 1 is connected to the positive pole of one of the groups of electrolytic baths 6, while the current rectifier 2 is connected to the other group of electrolytic baths 7. The negative poles of both bath groups, 6, 7 are connected to a first common point 11, while the negative poles of both current rectifiers 1, 2 are connected to a second common point 12. Between the common points 11, 12 there is connected a diode switch 8.

The time diagrams (FIGS. 2 and 3) of the currents 9, 10 (FIG. 1) passing through the baths 6, 7 illustrate the function of the electric system and the gist of the method of the invention. The common control block 5 switches on the current rectifiers 1, 2 at the first moment $t_1$. The currents 9, 10 passing through the baths are of normal direction with normal electrode polarity and have a predetermined intensity. At the second later moment $t_2$ both current rectifiers are switched off, which is necessary for damping the transition processes in the system. At the third moment $t_3$ the current rectifier 1 and the controllable switch 4 are switched on. The diode switch 8 is blocked by the electromotive voltage of the group of electric baths 7 and an electric current passes through both groups of electrolytic baths 6, 7; for the group of baths 6 its direction corresponds to their normal electrode polarity, and for the group of baths 7 its direction corresponds to their opposite electrode polarity.

At the expiration of a preset time until the moment $t_4$ and a further short-time stop, at the moment $t_5$ the current rectifier 2 and the controllable switch 3 are switched on. The diode switch 8 is blocked by the electromotive voltage of the group of electrolytic baths 6 and a current passes through both groups of electrolytic baths 6, 7; for the group of baths 6 its direction corresponds to their opposite electrode polarity, and for the group of baths 7 corresponds to their normal electrode polarity. At the expiration of a preset time, at the moment $t_6$ there follows a new short-time stop and the current rectifiers 1, 2 are again switched on at the moment $t_7$ for the next period of electric extraction.

Thus, each controllable current rectifier 1, 2 operates for a prolonged time for the electric extraction of metal in the electrolytic baths 6, 7 and only for a short time, e.g. from 0.5 to 6% of the duration of the electric extraction, for the disolution of the metal. At that during the dissolution in any arbitrary group of baths 6, resp. 7, the electromotive voltages of both groups of baths 6, 7 compensate each other, totally or partially, and the dissolution takes place under the action of the current which provides the electric extraction in the other group of baths 7, resp. 6. The current density in dissolution can be equal to 0.5 to 1.2 of the current density in continued electric extraction, while the frequency of switching on any of the current rectifiers for continued electric extraction of 1 to 8 times per minute.

The thyristors in the controllable switches 3, 4 operate with direct current, which permits their maximum utilization by current. The time distribution of the current favors a uniform deposition and the gradient of diffusion limitations, and as a result the metal output by current is increased.

The reversive electric extraction in accordance with the present invention is effected at different current densities (with limits from 100 to 1500 A/m$^2$) and with different durations of deposition onto the cathode (for working cycles of from 12 to 144 hours). This is achieved by presetting definite reversive conditions for each metal and given technology, depending on given concrete conditions and requirements. The extraction of the metals from the electrolyte is effected by means of cathode bases of copper, zinc, nickel, molibdenum, lead, aluminium, stainless steel, titanium or their alloys. As "insoluble" anodes there are used cast, rolled or sintered sheets of lead and its alloys, suitable graphites and multi-layer anodes, suitably formed for their setting in normal operating state. This is carried out in order to increase the quality of the working anode surface and to reduce the anode voltage, to increase the wear resistance and efficiency of the electrode, which is achieved in a chemical, mechanical, thermal and electrochemical way.

EXAMPLE 1

Electric Extraction of Zinc.

The extraction of zinc from a sulphuric-acid electrolyte is effected under reversive conditions with a current value in dissolution equal to the current value in electric extraction. The process is conducted at a current density of b 600 A/m$^2$, a duration of the deposition until the detachment from the cathode of 48 hours at a frequency 4 times per minute, and a duration of dissolution equal to 1,5%. The matrices are of aluminium, the anodes of a lead alloy containing 1%silver, suitably formed, and the distance between the electrodes of equal polarity is 75 mm. The zinc yield by current is from 89 to 92% at a metal purity of from 99.95 to 99.995% zinc and an electric energy consumption of from 3300 to 3500 kwh/t.

EXAMPLE 2

Electric Extraction of Nickel.

The extraction of nickel from a mixed sulphate-chloride solution is effected under reversive conditions at a current value in dissolution equal to 0.85% of the current value in electric extraction. The process is conducted with a current density of 500 A/m$^2$, a duration of the deposition until the removal from the cathode of 96 hours at a frequency of 5 times per minute and of dissolution equal to a duration 5%. The matrices are of titanium, the anodes of high-quality graphite, and the distance between the electrodes of equal polarity is 100 mm.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a process for the electric extraction of nonferrous metals from first and second electrolytic baths each having a cathode and an anode associated therewith, the process comprising the steps of passing an electric current in a first direction through the electrodes of each of the first and second baths to extract metal from the bath, and periodically reversing the direction of current flow through each of the baths to dissolve metal in the bath, the improvement which comprises the steps of serially connecting a pair of like electrodes of the first and second baths to a common point; passing, during a first interval, a pair of separate DC current flows symmetrically through the interconnected first and second baths in the first direction along paths individually including the respective other electrodes of the baths and the common point; passing, during a second interval following the first interval, a common serial flow of DC current simultaneously through the first bath in the first direction and the second bath in the reverse direction; and passing, during a third interval following the second interval, a common serial flow of DC current simultaneously through the second bath in the first direction and the first bath in the reverse direction.

2. A process as defined in claim 1, in which the common serial flows of current through the first and second paths during each of the second and third intervals have a density equal to 0.5 – 1.2 times the density of the pair of separate current flows during the first interval.

* * * * *